US005298377A

United States Patent [19]

Bowne

[11] Patent Number: 5,298,377

[45] Date of Patent: Mar. 29, 1994

[54] PHOTOGRAPHIC ELEMENT WITH 2-EQUIVALENT MAGENTA DYE-FORMING COUPLER AND FILTER DYE

[75] Inventor: Arlyce T. Bowne, Rochester, N.Y.

[73] Assignee: Eastman Kodak Company, Rochester, N.Y.

[21] Appl. No.: 750,970

[22] Filed: Aug. 28, 1991

[51] Int. Cl.[5] ..... G03C 1/46

[52] U.S. Cl. ..... 430/507; 430/510; 430/555; 430/558; 430/504; 430/512; 430/522; 430/523

[58] Field of Search ..... 430/507, 510, 555, 558, 430/504, 512, 522, 523

[56] References Cited

U.S. PATENT DOCUMENTS

| | | | |
|---|---|---|---|
| 4,308,343 | 12/1981 | Ichijima et al. | 430/558 |
| 4,420,555 | 12/1983 | Krueger et al. | 430/507 |
| 4,923,788 | 5/1990 | Shuttleworth et al. | 430/507 |
| 4,940,654 | 7/1990 | Diehl et al. | 430/522 |
| 4,950,586 | 8/1990 | Diehl et al. | 430/507 |
| 5,077,182 | 12/1991 | Sasaki et al. | 430/504 |

FOREIGN PATENT DOCUMENTS

| | | |
|---|---|---|
| 319999 | 6/1989 | European Pat. Off. . |
| 62-010650 | 1/1987 | Japan . |

OTHER PUBLICATIONS

Girgis, et al. α, β-Unsaturated Nitriles in Heterocyclic Synthesis: The reaction of β-(2-Furanyl)- and β-(2--Thienyl)acrylonitrile with Active Methylene Reagents, Liebigs Ann. Chem. 1468-1475 (1983).

*Primary Examiner*—Charles L. Bowers, Jr.
*Assistant Examiner*—Thomas R. Neville
*Attorney, Agent, or Firm*—Gordon M. Stewart

[57] ABSTRACT

A photographic element is described having a photographic support;

a green sensitive silver halide emulsion layer on the photographic support and having a magenta dye-forming coupler, and a filter layer on the photographic support and associated with the green sensitive layer, wherein the magenta dye-forming coupler is a 2-equivalent magenta dye-forming coupler, and the filter layer includes a filter dye molecule having the formula:

$$D{=}CH{-}M \qquad (I)$$

wherein D is a group which, with the remainder of the molecule, forms a dye having an absorption maximum in the blue or green region of the visible spectrum, and M is a five-membered or six-membered unsaturated heterocyclic ring, which may be fused with another five-membered or six-membered ring system, and which is unsubstituted or substituted with a lower alkyl group having from 1 to 10 carbon atoms, or an electron withdrawing group.

24 Claims, No Drawings

PHOTOGRAPHIC ELEMENT WITH 2-EQUIVALENT MAGENTA DYE-FORMING COUPLER AND FILTER DYE

FIELD OF THE INVENTION

This invention relates to color photographic elements, particularly those with one or more of the light sensitive layers protected against exposure to light in the blue and/or green region of the spectrum by a yellow and/or a magenta filter dye layer(s).

BACKGROUND OF THE INVENTION

Color silver halide photographic materials generally contain layer units sensitive to each of the primary regions of the visible spectrum, i.e., the blue, green, and red regions, and coupler compounds. Such coupler compounds have the function of producing dyes to make up the images recorded in such materials. Usually, a yellow dye-forming coupler is associated with a blue sensitive silver halide emulsion layer, a magenta dye-forming coupler is associated with a green sensitive silver halide emulsion layer, and a cyan dye-forming coupler is associated with a red sensitive silver halide emulsion layer.

Silver halide employed in these materials has inherent sensitivity in the blue region of the visible spectrum. Increased sensitivity to blue light, along with sensitivity to green light or red light, is imparted through the use of various sensitizing dyes adsorbed on the silver halide grains. Sensitized silver halide, however, retains its intrinsic sensitivity to blue light, and, therefore, the red sensitive and green sensitive layers of color photographic elements are sensitive to radiation in the blue region of the spectrum as well as to radiation in the region of the spectrum intended to be recorded, i.e., green or red radiation, respectively.

If, prior to processing, blue light reaches a layer containing silver halide sensitized to a region of the spectrum other than blue, such exposed silver halide grains would be rendered developable, resulting in a false rendition of the image information recorded by the photographic element. It is common, therefore, to incorporate in the photographic element a material that filters blue light. This blue absorbing material can be located anywhere in the element where the filtering of blue light is desirable. In a photographic element with layers sensitized to each of the primary colors, it is common to have the blue sensitive layer closest to the exposure source and to impose a blue-absorbing, or yellow, filter layer between the blue sensitive layer and green and red sensitive layers.

Similarly, if the red layer sensitization is broad enough to respond to unwanted green light exposure, a false rendition of color is observed. In such instances, the use of a magenta filter dye residing below the green sensitive silver halide emulsion layer, but above the red sensitive layers, is advantageous. The green light is absorbed, and thus does not expose the red sensitive layers.

The material most commonly used as a blue-absorbing material in photographic elements is yellow colloidal silver, known in the art as Carey Lea silver. Carey Lea silver, however, exhibits unwanted absorption in the green region of the spectrum. Silver can also cause unwanted photographic fog. Filter dyes can provide the beneficial light absorption properties without the undesirable effects of Carey Lea silver. Examples of materials useful as filter dyes are those described in U.S. Pat. Nos. 4,420,555 to Krueger et al. and 4,923,788 to Shuttleworth et al.

There are many known classes of compounds that are useful as couplers in photographic materials. 5-Pyrazolone compounds and pyrazoloazole (e.g., pyrazolotriazole) compounds are well-known as magenta dye-forming couplers. Such couplers are described in, for example, James, *The Theory of the Photographic Process*, MacMillan, 1977. One type of magenta dye-forming coupler is the 4-equivalent type. With 4-equivalent couplers, a hydrogen atom is cleaved from the coupler compound at the coupling position when the compound couples with the oxidized color developer. Four moles of silver halide must be reduced in order to form one mole of dye from a 4-equivalent coupler.

A second type of magenta dye-forming coupler known in the art is the 2-equivalent type. As described below, such couplers require the reduction of two moles of silver halide to form one mole of dye.

When a 4-equivalent magenta dye-forming coupler is incorporated in a green sensitive layer adjacent to a filter layer having a certain known type of filter dye, an unacceptable increase in light-induced yellowing or "printout" of the post-processing image occurs. Therefore, a problem to be solved by this invention is a reduction in the printout increase which occurs when certain filter dyes are used in conjunction with 4-equivalent magenta dye-forming couplers. Elements of this type have been described in U.S. Pat. No. 4,923,788 to Shuttleworth et al.

Although the problem of an increase in printout is significant for both of the two major types of photographic elements, color negative and color reversal elements, it is a more serious problem with color reversal materials.

In color negative materials, the element is exposed to light and processed with a color developer that imagewise forms a silver image and a dye image. The silver image is formed due to the color developer's reduction of exposed silver halide to form silver and oxidized color developer. The dye image is formed by the reaction of oxidized color developer with dye-forming coupler. The silver image is bleached and solubilized for removal, leaving only a negative color dye image. This image is then used to expose another color negative material to form a positive color dye image.

In contrast, in reversal materials, the element is generally exposed and processed with a black-and-white developer to form a negative silver image in each layer. The remaining undeveloped silver halide thus forms a positive imagewise pattern. The undeveloped silver halide is then fogged and processed in a color developer to form a dye image along with the silver. All the silver is then bleached and solubilized for removal, leaving only the positive color dye image.

In color negative photography, the photographic element that was exposed to the image is thus used to print the finished product on a second photographic material. The effect of an unwanted increase in printout may be lessened through the use of various filters in conjunction with the printing equipment. No such masking opportunity exists with color reversal materials, because the element originally exposed to the image becomes the finished product upon processing. Any increase in printout is, therefore, more likely to be apparent in the final image with color reversal materials.

SUMMARY OF THE INVENTION

The present invention relates to photographic elements incorporating certain filter dye compounds in filter layers adjacent to green sensitive layers having a specific type of magenta dye-forming coupler. It has been found that the printout increase which occurs when certain filter dyes are used in conjunction with 4-equivalent magenta dye-forming couplers can be reduced by replacing the 4-equivalent couplers with 2-equivalent magenta dye-forming couplers.

Specifically, a photographic element in accordance with the invention comprises a photographic support, a green sensitive silver halide emulsion layer on the photographic support and having a magenta dye-forming coupler, and a filter layer having a filter dye, associated with the green sensitive layer, wherein the magenta dye-forming coupler is a 2-equivalent magenta dye-forming coupler and the filter dye molecule has the formula:

D=CH—M (I)

wherein D is a group which, with the remainder of the molecule, forms a dye having an absorption maximum in the blue or green region of the visible spectrum, and M is a five-membered or six-membered unsaturated heterocyclic ring, which may be fused with another five-membered or six-membered ring system, and which is unsubstituted or substituted with a lower alkyl group having from 1 to 10 carbon atoms, or an electron withdrawing group.

2-Equivalent magenta dye-forming couplers differ from 4-equivalent magenta dye-forming couplers in the type of group cleaved from the remainder of the coupler at the coupling position. In 4-equivalent couplers, as described above, a hydrogen atom is cleaved at the coupling position during development, whereas, the group cleaved from a 2-equivalent coupler at the coupling position during coupling with an oxidized color developer is a coupling-off group, such as a halogen or other displaceable group. 2-Equivalent couplers require the reduction of two moles of silver halide to silver to form one mole of dye.

In contrast to results obtained with photographic elements incorporating these filter dyes in filter layers associated with green sensitive layers having 4-equivalent magenta dye-forming couplers, elements in accordance with the invention exhibit no deleterious increase in printout following processing.

DETAILED DESCRIPTION OF THE INVENTION

As described above, a photographic element in accordance with the invention comprises:

a photographic support;

a green sensitive silver halide emulsion layer on the photographic support and having a magenta dye-forming coupler; and a filter layer on the photographic support associated with said green sensitive layer, wherein the magenta dye-forming coupler is a 2-equivalent magenta dye-forming coupler, and the filter layer comprises a filter dye molecule having the formula:

D=CH—M (I)

wherein D is a group which, with the remainder of the filter dye, forms a dye having an absorption maximum in the blue or green region of the visible spectrum, and M is a five-membered or six-membered unsaturated heterocyclic ring, which may be fused with another five-membered or six-membered ring system, and which is unsubstituted or substituted with a lower alkyl group having from 1 to 10 carbon atoms, or an electron withdrawing group.

By "associated with," it is meant that the green sensitive silver halide layer is either adjacent to the filter layer or otherwise sufficiently close to the filter layer so that the layers and/or their constituents operatively interact. While not wishing to be bound by theory, in some cases this operative interaction may involve the reaction of the magenta dye-forming coupler and the filter dye in their entireties and/or fragments thereof.

By "electron withdrawing group" it is meant a group having a Hammett's $\sigma$ para value exceeding 0.3. Hammett's $\sigma$ constants are described, for example, in Hansch et al. "*Aromatic" Substituent Constants for Structure-Activity Correlations* vol. 16, no. 11, 1207–1217 (1973). Examples of suitable electron withdrawing groups are a cyano group, a nitro group, substituted or unsubstituted carbamoyl groups having from 1 to 30 carbon atoms, such as methylcarbamoyl, ethylcarbamoyl, 4-methoxy-phenylcarbamoyl, N-methyl-N-octadecylcarbamoyl, 3-(2,4-di-pentylphenoxy)propylcarbamoyl, pyrrolidinocarbonyl, hexadecylcarbamoyl and di-n-octyl-carbamoyl groups, substituted or unsubstituted sulfamoyl groups having from 1 to 30 carbon atoms, such as methylsulfamoyl, diethylsulfamoyl, 3-(2,4-di-t-pentyl-phenoxy)propylcarbamoyl, phenylsulfamoyl, pyrrolidinosulfonyl and morpholinosulfonyl groups, substituted or unsubstituted alkoxycarbonyl groups having from 1 to 30 carbon atoms, such as methoxycarbonyl, ethoxycarbonyl, phenoxycarbonyl, 2-methoxyethoxycarbonyl, and hexadecyloxycarbonyl groups, substituted or unsubstituted sulfonyl groups having from 1 to 30 carbon atoms, such as methanesulfonyl, 4-methyl-phenylsulfonyl and dodecylsulfonyl groups, substituted or unsubstituted acyl groups having from 1 to 30 carbon atoms, such as acetyl, hexanoyl, benzoyl and 4-chloro-benzoyl groups, a trifluoromethyl group, a carboxyl group, and substituted or unsubstituted heterocyclic residues having from 1 to 30 carbon atoms, such as benzoxazole-2-yl and 5,5-dimethyl-2-oxazoline-2-yl groups, as described in U.S. Pat. No. 4,740,453.

When M is a six-membered heterocyclic ring, the ring preferably contains at least one nitrogen atom. Examples of useful heterocyclic rings include furan, thiophene, pyridine, pyrrole, and imidazole. These rings may be substituted with any of a number of known substituents including, but not limited to sulfo, sulfato, sulfonamido (e.g., butanesulfonamido), amido, amino, carboxyl, halogen, alkoxy, hydroxy, acyl, phenyl, alkyl, and the like. The substituents can be located essentially anywhere on the ring or rings comprising M.

The 2-equivalent magenta dye-forming couplers useful in the practice of the invention can be members of any of the classes of couplers that are well-known in the art, as described, for example, in the above-referenced James, *The Theory of the Photographic Process*. These include both 5-pyrazolone couplers and pyrazoloazole couplers such as pyrazolotriazole couplers. In a preferred embodiment, the 2-equivalent magenta dye-forming couplers are ballasted couplers, which have sufficient bulk to be incorporated in particular layers of the photographic element.

2-Equivalent 5-pyrazolone couplers as a class are well-known to one skilled in the art. The couplers may be polymeric or non-polymeric, as described, for example, in commonly assigned and co-pending U.S. application Ser. No. 696,313 of Bowne, filed Apr. 30, 1991. Non-polymeric 2-equivalent 5-pyrazolone couplers which are useful in the present invention include the following:

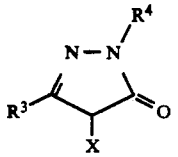

(II)

wherein $R^3$ is a carbonamido group, an arylamino group, a ureido group, a sulfonamido group, an alkylamino group, or a heterocyclic amino group, $R^4$ is a substituted or unsubstituted alkyl or aryl group, and X is a group capable of being released by a coupling reaction with an oxidized aromatic primary amine developing agent (hereinafter a "coupling-off" group).

Such coupling-off groups are known in the art and may include a group containing an aliphatic group, an aromatic group, a heterocyclic group, an aliphatic, aromatic, or heterocyclic sulfonyl group, or an aliphatic, aromatic, or heterocyclic carbonyl group that is bonded to the coupling active carbon via an oxygen atom, a nitrogen atom, a sulfur atom, or a carbon atom, a halogen atom, an aromatic azo group, and the like. The aliphatic, aromatic, or heterocyclic group contained in such coupling-off groups may have one or more substituents, as described below.

Examples of coupling-off groups include a halogen atom (e.g., fluorine, chlorine, bromine), an alkoxy group (e.g., ethoxy, dodecycloxy, carboxypropyloxy), and aryloxy group (e.g., 4-chlorophenoxy group, a 4-methoxyphenoxy group), an acyloxy group (e.g., an acetoxy group, a tetradecanoloxy group), an aliphatic or aromatic sulfonyloxy group (e.g., a methanesulfonyloxy group, a toluenesulfonyloxy group), an acylamino group (e.g., a dichloroacetylamino group, a trifluoroacetylamino group), an aliphatic or aromatic sulfonamido group (e.g., a methanesulfonamido group, a p-toluenesulfonamido group), an alkyloxycarbonyloxy group (e.g., an ethoxycarbonyloxy group), an aryloxycarbonyloxy group (e.g., a benzyloxycarbonyloxy group, a phenoxycarbonyloxy group), an aliphatic, aromatic or hetercyclic thio group (e.g., an ethylthio group, a phenylthio group), a carbamoylamino group (e.g., an N-methylcarbamoylamino group, an N-phenylcarbamoylamino group), a 5-membered or 6-membered nitrogen-containing heterocyclic group (e.g., an imidazolyl group, a pyrazolyl group), an imido group (e.g., a succinimido group, a hydantoinyl group), an aromatic azo group (e.g., a phenylazo group), and the like.

The aliphatic, aromatic, or heterocyclic groups encompassed by X and the groups covered by $R^3$ and $R^4$ may be substituted by a substituent such as, for example a halogen atom (e.g., a fluorine atom, a chlorine atom, a bromine atom, etc.), an alkyl group (e.g., a methyl group, a t-octyl group, a dodecyl group, a trifluoromethyl group, etc.), an alkenyl group (e.g., an allyl group, an octadecenyl group, etc.), an aryl group (e.g., a phenyl group, a p-tolyl group, a naphthyl group, etc.), an alkoxy group (e.g., a methoxy group, a benzyloxy group, a methoxyethoxy group etc.), an aryloxy group (e.g., a phenoxy group, a 2,4-di-tert-amylphenoxy group, a 3-tert-butyl-4-hydroxyphenoxy group, etc.), an acyl group (e.g., an acetyl group, a benzoyl group, etc.), a sulfonyl group (e.g., a methanesulfonyl group, a toluenesulfonyl group, etc.), a carboxy group, a sulfo group, a cyano group, a hydroxy group, an amino group (e.g., a primary amino group, a dimethylamino group, etc.), a carbonamido group (e.g., an acetamido group, a trifluoroacetamido group, a tetradecanamido group, a benzamido group, etc.), a sulfonamido group (e.g., a methanesulfonamido group, a hexadecanesulfonamido group, a p-toluenesulfonamido group, etc.), an acyloxy group (e.g., an acetoxy group, etc.), a sulfonyloxy group (e.g., a methanesulfonyloxy group, etc.), an alkoxycarbonyl group (e.g., a dodecyloxycarbonyl group, etc.), an aryloxycarbonyl group (e.g., phenoxycarbonyl group, etc.), a carbamoyl group (e.g., a dimethylcarbamoyl group a sulfamoyl group (e.g., a methylsulfamoyl group, a hexadecylsulfamoyl group, etc.), an imido group (e.g., a succinimido group, a phthalimido group, an octadecenylsuccinimido group, etc.), a heterocyclic group (e.g., a 2-pyridyl group, a 2-furyl group, a 2-thienyl group, etc.), an alkylthio group (e.g., a methylthio group, etc.), and an arylthio group (e.g., a phenylthio group, etc.).

Another example of a coupler having a releasable group through a carbon atom for X is a so-called bis type coupler obtained by condensing a 4-equivalent coupler with an aldehyde or a ketone.

Any one of $R^3$, $R^4$ and X may be a divalent or a more polyvalent group to form an oligomer such as a dimer, etc., or may connect a polymeric main chain and a coupler skeleton to form a polymeric coupler, as shown below in formulas (III), (IV), and (V).

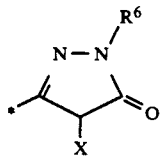

(III)

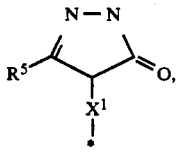

(IV)

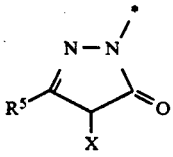

(V)

In these formulas, R6 represents an alkyl group, a substituted alkyl group (e.g., a haloalkyl group such as fluoroalkyl, or cyanoalkyl and benzylalkyl groups), or a substituted or unsubstituted aryl group. Examples of the substituent include an alkyl group (e.g., a methyl group and an ethyl group), an alkoxyl group (e.g., a methoxy group and an ethoxy group), an aryloxy group (e.g., a phenyloxy group), an alkoxycarbonyl group (e.g., a methoxycarbonyl group), an acylamino group (e.g., an acetylamino group), a carbamoyl group, an alkylcarbamoyl group (e.g., a methylcarbomoyl group and an ethylcarbamoyl group), a dialkylcarbamoyl group (e.g., a dimethylcarbamoyl group), an arylcarbamoyl group (e.g., a phenylcarbamoyl group), an alkylsulfonyl group (e.g., a methylsulfonyl group), an alkylsulfonamido group (e.g., a methanesulfonamido group), an arylsulfonamido group (e.g., a phenylsulfonamido group), a sulfamoyl group, an alkylsulfamoyl group (e.g., an ethylsulfamoyl group), a dialkylsulfamoyl group (e.g., a dimethylsulfamoyl group), an alkylthio group (e.g., a methylthio group), an arylthio group (e.g., a phenylthio group), a cyano group, a nitro group, and a halogen atom (e.g., fluorine, chlorine and bromine); when the aryl group is substituted with two or more substituents, they may be the same or different.

When $R^6$ is an aryl group, preferred examples of the substituent are a halogen atom, an alkyl group, an alkoxyl group, an alkoxycarbonyl group, and a cyano group. A particularly preferred substituent is a halogen atom.

$R^5$ is a substituted or unsubstituted arylamino group (e.g., an anilino group), a carbonamido group (e.g., an alkylcarbonamido group, a phenylcarbonamido group, an alkoxycarbonamido group and a phenyloxycarbonamido group), a ureido group (e.g., an alkylureido group and a phenylureido group), a sulfonamido group, and alkylamino group, a heterocyclic amino group, and preferably is a carbonamido group.

X is a coupling-off group as defined above. Particularly preferred examples of the releasable group are nitrogen atom-containing releasable groups forming a heterocyclic ring such as an imidazolyl group and a pyrazolyl group, and sulfur atom-containing releasable groups such as an alkylthio group and an arylthio group.

$X^1$ represents a divalent group, derived from X, having bonding sites to the pyrazolone ring and to $-(Y)_q-$ in formulas (VI) and (VII), below.

In formulas (III), (IV) and (V), * indicates a site where the structure is linked to $-(Y)_q-$ in the formulas (VI) and (VII):

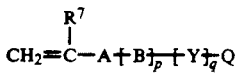

(VI)

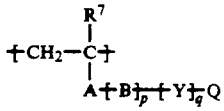

(VII)

In formulas (VI) and (VII), $R^7$ is a hydrogen atom, a lower alkyl group having from 1 to 4 carbon atoms, or a chlorine atom, A is —CONH—, —COO—, —O—, or a phenylene group, B is a substituted or unsubstituted straight or branched alkylene group, aralkylene group, or phenylene group, Y is —CONR'—, —NR'CONR'—, —NR'COO—, —NR'CO—, —OCONR'—, —NR'—, —COO—, —OCO—, —CO—, —O—, $-SO_2-$, $-NR'SO_2-$ or $-SO_2NR'-$, wherein R' is a hydrogen atom or a substituted or unsubstituted aliphatic group or aryl group, and when two or more R's are present in one molecule, R's may be same or different, q is 0 or 1, p is 0 when q is 0, or 1 when q is 1, and Q represents the 2-equivalent magenta coupler structure of formulas (III), (IV), and (V).

The polymer couplers useful in the present invention may be homopolymers of monomer couplers represented by formula (VI), or a copolymer of two or more of monomer couplers represented by formula (VI), or a copolymer of a monomer coupler of formula (VI) and one or more non-color-forming ethylenic monomers which does not couple with an oxidized product of an aromatic primary amine developing agent. Even in this case, as the monomer coupler of formula (VI), a copolymer comprising two or more of a monomer couplers represented by formula (VI) together with one or more non-color-forming ethylenical monomers may be used.

The ethylenical monomer not forming color on coupling with an oxidized product of an aromatic primary amine developing agent includes acrylic acid, α-chloroacrylic acid, α-alkylacrylic acid (e.g., methacrylic acid), and their ester or amide derivatives (e.g., acrylamide, methacrylamide, n-butylacrylamide, tert-butylacrylamide, diacetoneacrylamide, methylenebisacrylamide, methyl methacrylate, ethyl acrylate, n-propyl acrylate, n-butyl acrylate, tert-butyl acrylate, iso-butyl acrylate, 2-ethylhexyl acrylate, n-octyl acrylate, lauryl acrylate, methyl methacrylate, ethyl methacrylate, n-butylmethacrylate, and β-hydroxyl methacrylate), vinyl esters (e.g., vinyl acetate, vinyl propionate and vinyl laurate), acrylonitrile, methacrylonitrile, aromatic vinyl compounds (e.g., styrene and its derivatives, such as vinyltoluene, divinylbenzene, vinylacetophenone and sulfonstyrene), itaconic acid, citraconic acid, crotonic acid, vinylidene chloride, vinyl alkyl ethers (e.g., vinyl ethyl ether), maleic acid esters, N-vinyl-2-pyrrolidone, N-vinylpyridine, and 2- and 4-vinylpyridine.

Particularly preferred examples are acrylic acid esters, methacrylic acid esters, and maleic acid esters. The above non-color forming ethylenically unsaturated monomers can be used as mixtures comprising two or more thereof. Typical examples are a combination of methyl acrylate and butyl acrylate, a combination of butyl methacrylate and methacrylic acid, and a combination of methyl acrylate and diacetone acrylamide.

As is well known in the polymer coupler field, the type of the ethylenically unsaturated monomer to be copolymerized with the monomer coupler of the general formula (V) can be chosen appropriately so as to exert favorable influences on the physical and/or chemical properties of the resulting copolymer, such as solubility, compatibility with a binder (e.g., gelatin) of a photographic colloid composition, flexibility, and heat stability.

The magenta polymer coupler as used herein can be conveniently handled in the form of a latex during the preparation of light-sensitive material. This latex can be prepared by two methods. In one method, an olephilic polymer coupler, as prepared by polymerization of the above monomer coupler, is dissolved in an organic solvent and then dispersed or emulsified in an aqueous gelatin solution. In the other method, a direct emulsion polymerization is carried out. The former method is described in U.S. Pat. No. 3,451,820, and the latter method is described in U.S. Pat. Nos. 4,080,211 and 3,370,952.

As a polymerization initiator and a polymerization solvent for use in the synthesis of the magenta polymer coupler of the present invention, compounds as described in Japanese patent applications (OPI) 81/5543, 82/94752, (i.e., U.S. Pat. No. 4,367,282) 82/176038 (i.e., U.S. Pat. No. 4,388,404), 82/204038 (i.e., U.S. Pat. No. 4,416,978) 83/28745 (i.e., U.S. Pat. No. 4,409,320), 83/10738, 83/42044, 83/145944 (i.e., U.S. Pat. No. 4,436,808), 83/224352 and 84/42543 (i.e., German Patent No. 2,127,984B) can be used.

The polymerization temperature is determined from the molecular weight of the polymer formed, the type of polymerization initiation, etc. The polymerization temperature can be between 0° and 100° C., usually, 30° to 100° C.

The proportion of the color forming portion of the monomer of formula (V) in the copolymer coupler is usually from 5 to 80 wt %. In view of color reproductivity, color forming properties and stability, the proportion is preferably from 20 to 70 wt %. In this case, the molecular weight equivalent (i.e., the number of grams of the polymer containing 1 mol of the monomer coupler) is preferably (but not necessarily) from about 250 to 4,000.

Where groups above are described as substituted or unsubstituted, unless otherwise indicated, substituents for the groups can include, for example, a halogen atom, an alkyl group, an aryl group, a heterocyclic group, a cyano group, an alkoxy group, and aryloxy group, a heterocyclic oxy group, an acyloxy group, a carbamoyloxy group, a silyloxy group, a sulfonyloxy group, and acylamino group, an anilino group, a ureido group, an imido group, a sulfonylamino group, an arylthio group, a carbamoylamino group, an alkylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, an aryloxycarbonyl group, an alkenyl group, a carboxyl group, a sulfo group, a hydroxyl group, an amino group, and a carbonamido group, etc. $R^5$ preferably represents an arylamino group, a carbonamido group, a sulfonamido group or a ureido group and $R^6$ preferably is a substituted aryl group.

Examples of polymeric 2-equivalent 5-pyrazolone couplers include:

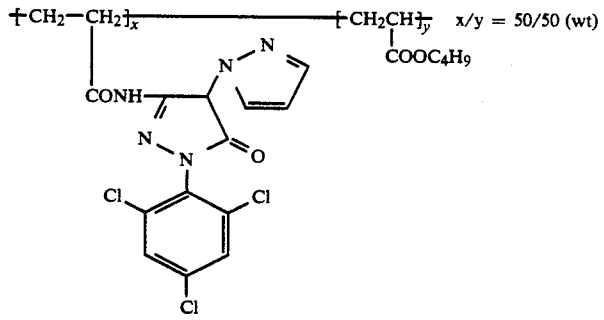

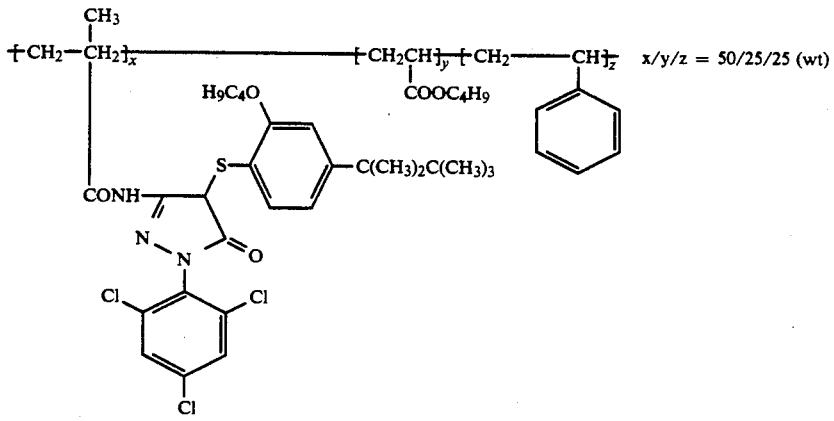

-continued

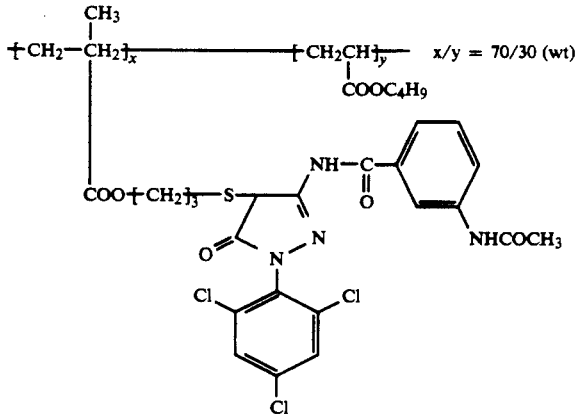

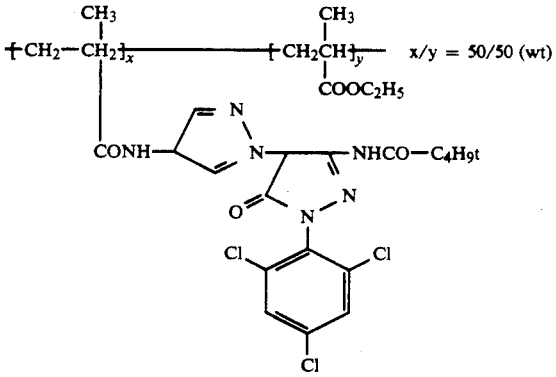

Other 2-equivalent 5-pyrazolone couplers which are useful in the present invention are described in U.S. Pat. Nos. 4,791,051, 4,863,841, and 4,367,282, which are hereby incorporated herein by reference.

Another useful class of magenta couplers are pyrazoloazole couplers, as described, for example, in commonly assigned and co-pending U.S. application Ser. No. 568,398, filed Aug. 16, 1990. Pyrazoloazole couplers useful in the practice of the invention include those according to the formula:

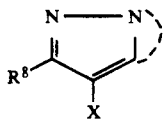

(VIII)

wherein $R^8$ is a hydrogen atom or a substituted or unsubstituted alkyl, aryl, alkoxy or aryloxy group.

X is as defined above for formula (II), and

J represents the non-metallic atoms necessary to complete a heterocyclic ring.

A more specific expression of compounds according to formula (VIII) is formula (IX):

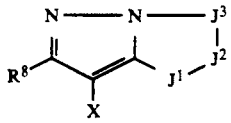

(IX)

wherein $R^8$ is a hydrogen atom or a substituted or unsubstituted alkyl, aryl, alkoxy or aryloxy group.

X is as defined above for formula (II), $J^1$, $J^2$, and $J^3$ each represents a substituted or unsubstituted methine group, =N—, or —NH—, wherein:

one of either the $J^1$—$J^2$ bond or the $J^2$—$J^3$ bond is a double bond with the other being a single bond, when the $J^2$—$J^3$ bond is a carbon-carbon double bond, it may form part of an aromatic ring, and when any one of $R^8$, X, and a substituted methine group represented by $J^1$, $J^2$, or $J^3$ is a divalent or polyvalent group, it may form a dimer or a polymer.

Examples of 2-equivalent magenta dye-forming couplers useful in the practice of the invention are presented below.

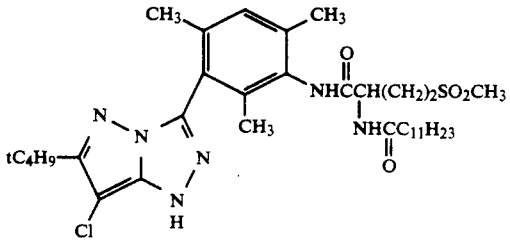

-continued
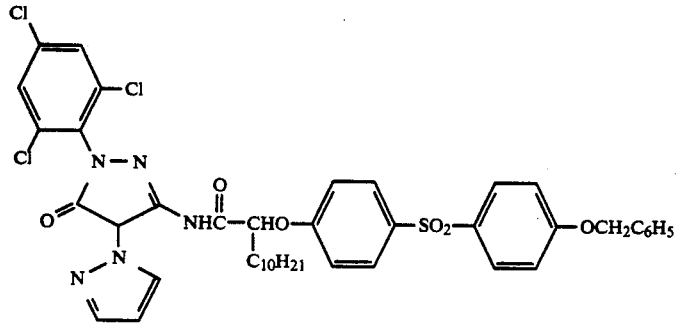
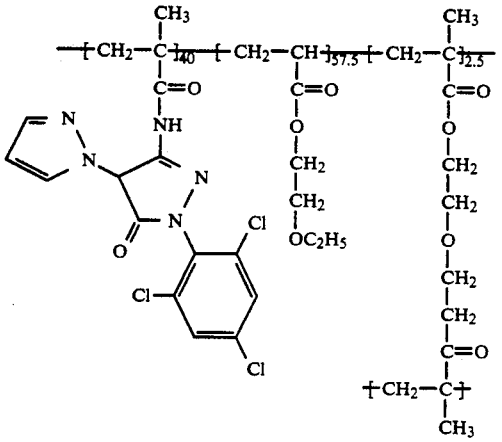
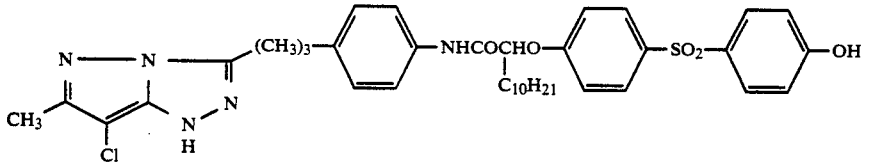
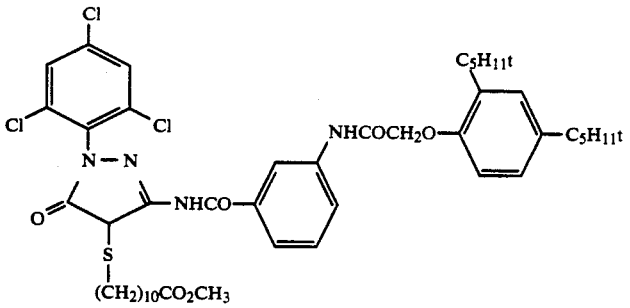
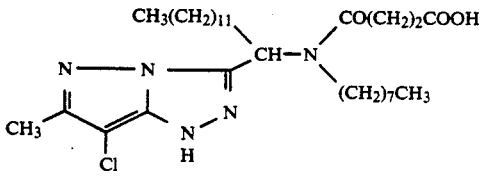

-continued

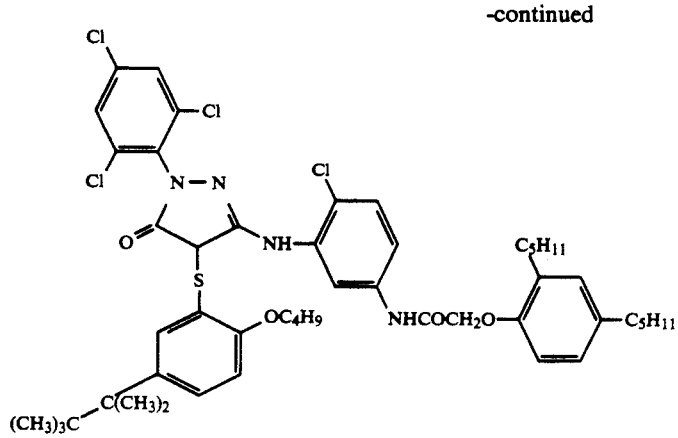

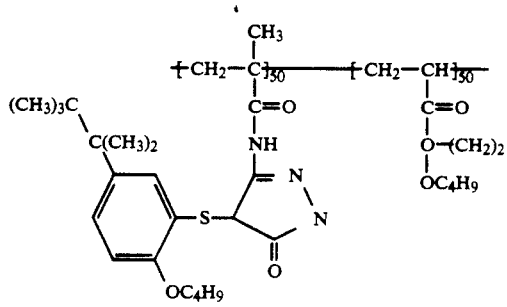

The filter dyes useful in the practice of the invention are those according to formula (I) above. Such filter dyes are well-known in the photographic art. Some are shown and described in the above-referenced U.S. Pat. No. 4,923,788 to Shuttleworth, et al., which is hereby incorporated by reference.

More specifically, filter dyes useful in the present invention include those having the formula (X):

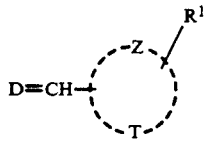

(X)

wherein D is as defined above for formula (I),

T is —O—, —S—, or —$NR^2$—, wherein $R^2$ is a bridging bonding valence, a hydrogen atom, or a lower alkyl group having from 1 to 4 carbon atoms, $R^1$ is a hydrogen atom, a lower alkyl group having from 1 to 10 carbon atoms, or an electron withdrawing group, and Z represents the atoms necessary to complete a five-membered or six-membered unsaturated heterocyclic ring containing T and additionally up to one nitrogen atom, the remainder of the ring atoms being carbon atoms.

By "bridging bonding valence" is meant electrons available for forming a double bond.

Preferred filter dyes according to formulas (I) and (X) are more specifically represented by the formula (XI):

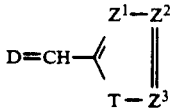

(XI)

wherein D and T are as described above for formula (X) and $Z^1$, $Z^2$, and $Z^3$ each independently represents —$CR^{10}$— or —N—, wherein at least two of $Z^1$, $Z^2$, and $Z^3$ are —$CR^{10}$— and each $R^{10}$ is independently a hydrogen atom, a lower alkyl group having from 1 to 10 carbon atoms or, an electron withdrawing group.

In one embodiment of the invention, filter dyes useful in the present invention include those having the formula (XII):

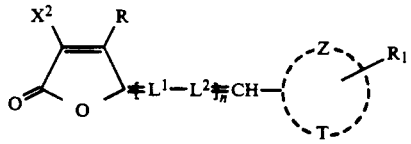

(XII)

wherein R is a substituted or unsubstituted alkyl group or aryl group, $X^2$ is an electron withdrawing group, $L^1$ and $L^2$ are each independently a substituted or unsubstituted methine group, and n is 0 or a positive integer from 1 to 6.

Preferred alkyl groups for R have from 1 to 20 carbon atoms and include straight chain alkyls such as methyl, ethyl, propyl, butyl, pentyl, decyl, dodecyl, etc., branched alkyl groups such as isopropyl, isobutyl, t-butyl, and the like. These alkyl groups may be substituted with any of a number of known substituents, such as sulfo, sulfato, sulfonamido, amido, amino, carboxyl, halogen, alkoxy, hydroxy, phenyl, and the like. The substituents may be located essentially anywhere on the alkyl group. The possible substituents are not limited to those exemplified, and one skilled in the art could easily choose from a number of substituted alkyl groups that would provide useful compounds according to formula (X).

Preferred aryl groups for R have 6 to 10 carbon atoms (e.g., phenyl, naphthyl), which may be substituted. Useful substituents for the aryl group include any of a number of known substituents for aryl groups, such as sulfo, sulfato, sulfonamido (e.g., butanesulfonamido), amido, amino, carboxyl, halogen, alkoxy, hydroxy, acyl, phenyl, alkyl, and the like. Additionally, the aryl group may have substituents that form fused ring systems with it, such as naphthyl. The substituents can be located essentially anywhere on the ring. The possible substituents are not limited to those exemplified, and one skilled in the art could easily choose from a number of substituted aryl groups that would provide useful compounds according to formula (X).

$X^2$ represents an electron withdrawing group, as described above for formula (I). Electron withdrawing groups in organic compounds are well-known in the art, such as described in J. Marsh, *Advanced Organic Chemistry*, 3rd. Ed., the disclosure of which is hereby incorporated herein by reference in its entirety. Useful electron withdrawing groups include, for example, cyano, substituted or unsubstituted carboxylate (preferably having 2 to 7 carbon atoms, e.g., $COR^{11}$ where $R^{11}$ is a substituted or unsubstituted alkyl or aralkyl), and $COR^9$ where $R^9$ is a primary or secondary amino group, and aryl groups (either unsubstituted or substituted with an electron withdrawing group, e.g., phenyl, p-nitrophenyl, p-cyanophenyl, 3,4-dichlorophenyl). The possible substituents for the various $X^2$ and $R^{11}$ groups will be known to those skilled in the art and include those described herein for R.

In another embodiment of the invention, filter dyes useful in the present invention include those having the formula (XIII):

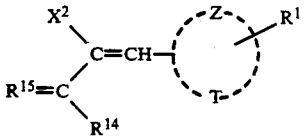

(XIII)

wherein $X^2$ is as defined above for formula (XII), $R^{14}$ is a substituted or unsubstituted aryl or heterocyclic group, and $R^{15}$ is an oxygen atom, or

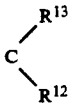

(XIV)

wherein $R^{12}$ and $R^{13}$, which may be the same or different, are each independently substituted or unsubstituted alkyl or aryl groups, carbonyl groups, cyano groups, nitrogen- or oxygen-containing heterocyclic groups, primary or secondary amino groups, or oxygen atoms, and wherein $R^{12}$ and $R^{13}$ may bond to form a ring, as indicated by the dashed line connecting $R^{12}$ and $R^{13}$ in formula (XIV).

Useful substituents for $R^{12}$, $R^{13}$ and $R^{14}$ include those described above for R.

Examples of useful filter dyes according to formula (I) are shown below:

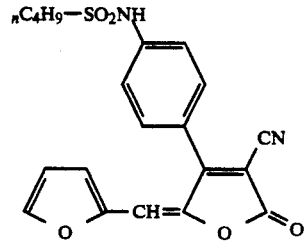

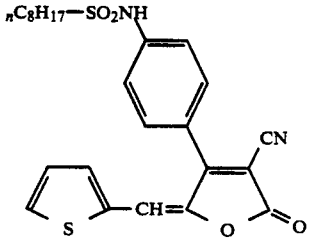

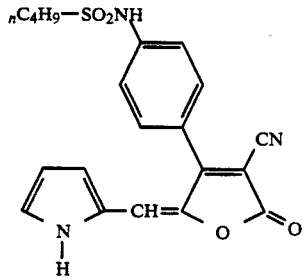

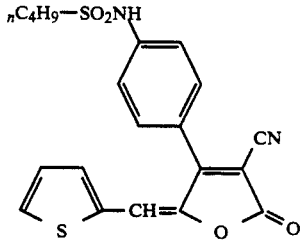

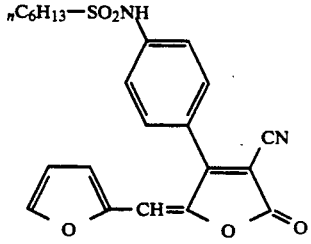

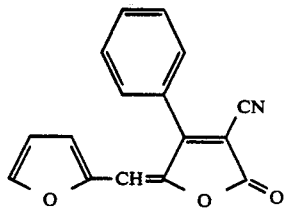

-continued
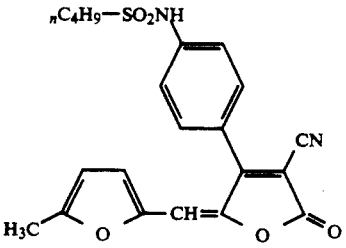
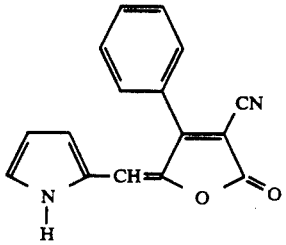
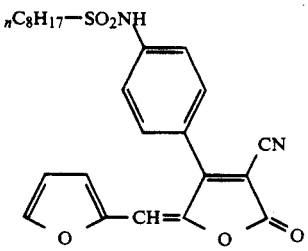
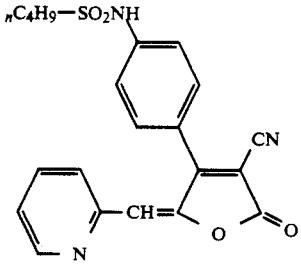
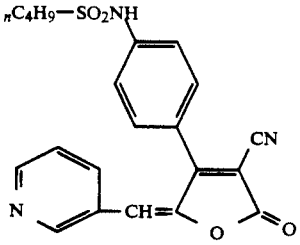
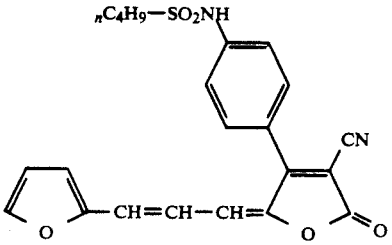
-continued
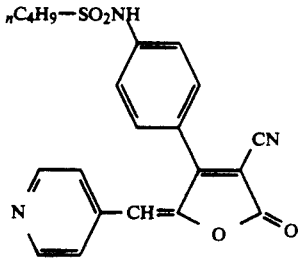
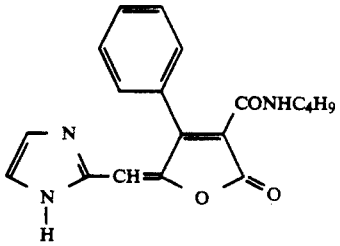
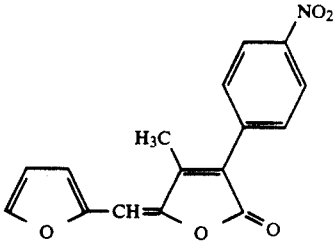
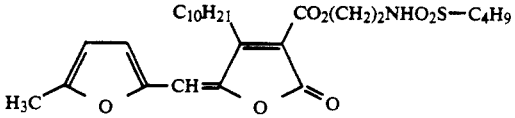
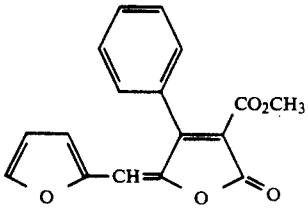
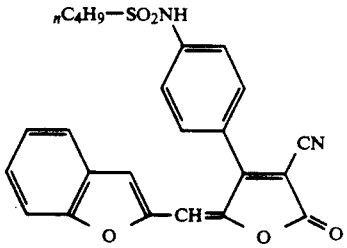
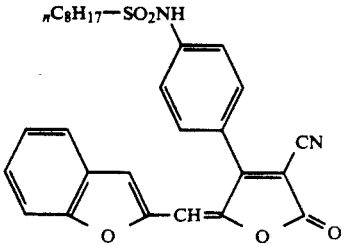

-continued
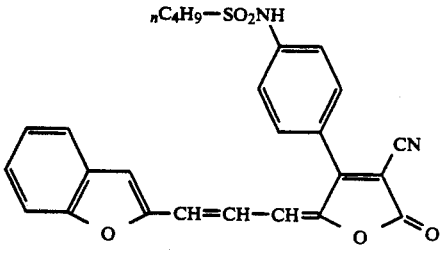
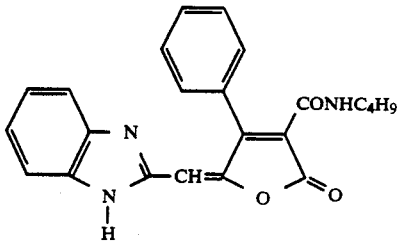
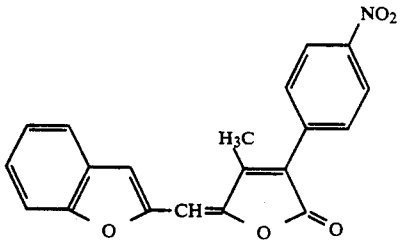
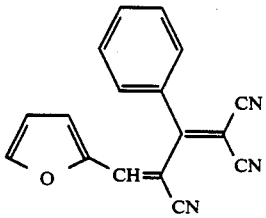
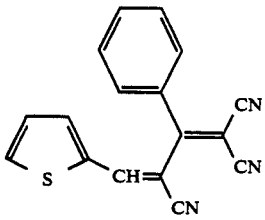
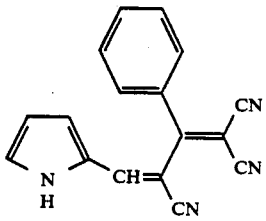
-continued
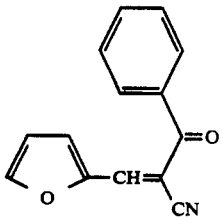
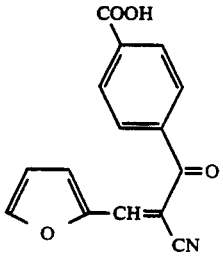
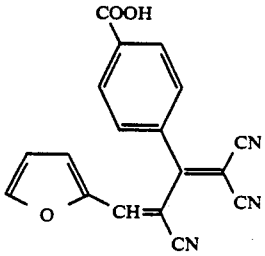
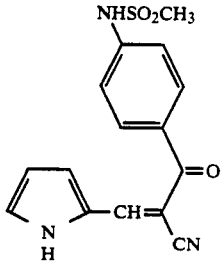
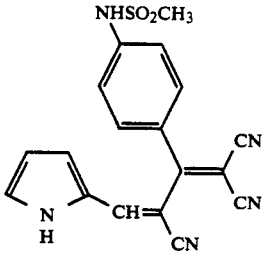
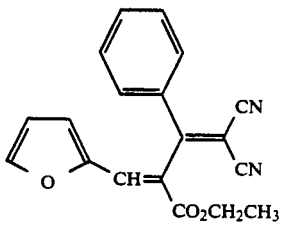

-continued

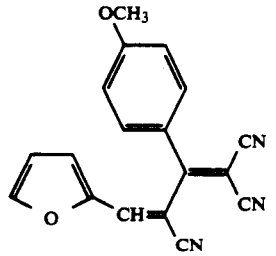

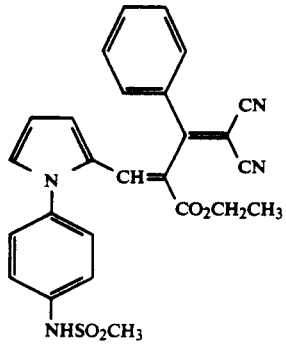

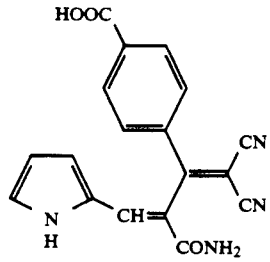

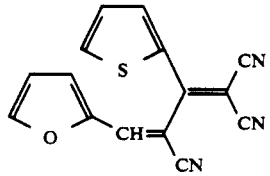

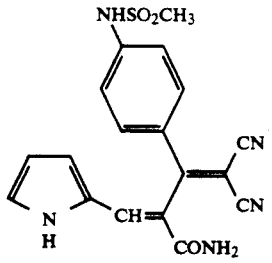

The dyes of formula (I) can be prepared by well known chemical synthetic techniques, as described, for example, in U.S. Pat. No. 4,923,788 and in Hamer, *The Cyanine Dyes and Related Compounds*, Interscience Publishers 1964.

The present invention is particularly useful for color reversal systems, which unlike color negative systems, do not offer the option of compensating for unwanted printout during the printing process. In reversal processes, the photographic element is free of colored couplers. The latent image is developed first in a black-and-white developer, thus using up the exposed silver halide. Then, the residual silver halide is activated either by exposure or chemically, thereby becoming developable. In the presence of color developing agents, the activated silver halide in a blue sensitive layer is developed to yield primarily a yellow dye. In a green sensitive layer, it yields primarily a magenta dye, and, in a red sensitive layer, it produces primarily a cyan dye. All of the developed silver is then removed.

In contrast, colored couplers are incorporated in the layers of a color negative photographic element. The presence of these couplers masks undesirable absorptions of the negative image for printing onto a second photographic material. The color negative can be printed onto a similar material to obtain, after processing, a positive image.

In a preferred embodiment of the invention, the photographic element is a color reversal photographic element, such as those processable in Kodak E-6® processing (e.g., Kodak Ektachrome® products, Fuji Fujichrome® products). E-6® processing is described in *British Journal of Photography Annual*, 1977 pp. 194–197.

The photographic support of the element of the present invention can be any of a number of well-known supports for photographic elements. These include polymeric films such as cellulose esters (e.g., cellulose triacetate and diacetate) and polyesters of dibasic aromatic carboxylic acids with divalent alcohols (e.g., poly(ethylene terephthalate)), paper, and polymer-coated paper. Such supports are described in further detail in *Research Disclosure*, December, 1989, Item 308119 [hereinafter referred to as *Research Disclosure I*], *Section XVII.*

The silver halide emulsion used in the practice of the invention can contain, for example, silver bromide, silver chloride, silver iodide, silver chlorobromide, silver chloroiodide, silver bromoiodide, or mixture thereof. The emulsions can include coarse, medium, or fine silver halide grains bounded by 100, 111, or 110 crystal planes. Silver halide emulsions and their preparation are further described in *Research Disclosure I*, Section I. Also useful are tubular grain silver halide emulsions, as described in *Research Disclosure*, January, 1983, Item 22534 and U.S. Pat. No. 4,425,426.

The 2-equivalent magenta dye-forming couplers (or mixtures of such couplers) and the filter dye of formula (I) (or mixtures of such filter dyes), when used according to the present invention, can be incorporated in layers of photographic materials by techniques well-known in the art. One common technique involves the use of high-boiling water-immiscible organic solvents and/or surfactants. Useful organic solvents include tricresyl phosphates, di-n-butyl phthalate, and others described in *Research Disclosure I*, Section XI. Mixtures of solvents and surfactants may also be used.

The filter dyes, when used according to the present invention, can be incorporated in the layers of the photographic materials by techniques well-known in the art. A preferred method involves the use of these dyes as solid particle dispersions as described in U.S. Pat. No. 4,940,654 to Diehl et al., which is hereby incorporated by reference.

The silver halide described above can be sensitized to a particular wavelength range of radiation, such as the red, blue, or green portions of the visible spectrum, or other wavelength ranges, such as ultraviolet, infrared, and the like. In a preferred embodiment, the silver halide emulsion associated with the 2-equivalent magenta dye-forming coupler is spectrally sensitized to green light so as to complement the magenta color of the dye formed by the coupler during processing. Chemical sensitization of silver halide can be accomplished with chemical sensitizers such as gold compounds, iridium compounds, or other group VIII metal compounds. Spectral sensitization is accomplished with spectral sensitizing dyes such as cyanine dyes, merocyanine dyes, styryls, or other known spectral sensitizers. Additional information on sensitization of silver halide is described in *Research Disclosure I*, Sections I–IV.

The filter dye of formula (I) and the 2-equivalent magenta dye-forming coupler may be located in any of a number of associated layers of a photographic element, depending on the specific requirements of the element and the dye, and on the manner in which the element is to be exposed. Either the filter dye-containing filter layer on the green sensitive layer containing the 2-equivalent magenta dye-forming coupler of a given pair of adjacent layers may be closer to the support than the other.

The photographic element of the present invention may be a color element or monochromatic. Multicolor photographic elements according to the invention generally comprise a blue sensitive silver halide layer having a yellow color-forming coupler associated therewith, a green sensitive layer having a magenta color-forming coupler associated therewith, and a red sensitive silver halide layer having a cyan color-forming coupler associated therewith. Color photographic elements and color-forming couplers are well-known in the art and are further described in *Research Disclosure I*, Section VII.

The element of the invention can also include any of a number of other well-known additives and layers, as described in *Research Disclosure I*. These include, for example, optical brighteners, antifoggants, oxidized developer scavengers, development accelerators, image stabilizers, light-absorbing materials such as filter layers or intergrain absorbers, light-scattering materials, gelatin hardeners, coating aids and various surfactants, overcoat layers, interlayers and barrier layers, antistatic layers, plasticizers and lubricants, matting agents, development inhibitor-releasing couplers, bleach accelerator-releasing couplers, and other additives and layers known in the art.

The photographic elements of the invention, when exposed, are processed to yield an image. Processsing can be by any type of known photographic processing, as described in *Research Disclosure I*, Sections XIX–XXIV. A negative image can be developed by color development with a chromogenic developing agent followed by bleaching and fixing. A positive image can be developed by sequentially developing with a non-chromogenic developer, uniformly fogging the element, and developing with a chromogenic developer.

Bleaching and fixing can be performed with any of the materials known to be used for that purpose. Bleach baths generally comprise an aqueous solution of an oxidizing agent such as water soluble salts and complexes of iron (III) (e.g., potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like.

The invention is further illustrated by the following Examples:

EXAMPLE 1

A cellulose triacetate film support provided with a subbing layer was coated with each layer having the composition set forth below to prepare a multilayer color photographic light-sensitive material, which was designated sample 101.

In the composition of the layers, the coating amounts are shown as g/m$^2$ except for sensitizing dyes, which are shown as the molar amount per mole of silver halide present in the same layer.

| | |
|---|---|
| First Layer: Antihalation Layer | |
| Black Coloidal Silver | 0.43 (as silver) |
| Gelatin | 2.44 |
| Second Layer: Intermediate Layer | |
| Gelatin | 1.22 |
| Third Layer: Slow Red Sensitive Layer | |
| Silver Iodobromide Emulsion | 0.36 (as silver) |
| Red Sensitizing Dyes | $1.42 \times 10^{-3}$ |
| Cyan Coupler C-1 | 0.54 |
| Solvent-2 | 0.27 |
| Gelatin | 0.86 |
| Fourth Layer: Fast Red Sensitive Layer | |
| Silver Iodobromide Emulsion | 0.48 (as silver) |
| Red Sensitizing Dyes | $1.05 \times 10^{-3}$ |
| Cyan Coupler C-1 | 0.97 |
| Solvent-2 | 0.49 |
| Gelatin | 1.51 |
| Fifth Layer: Intermediate Layer | |
| Competitor-1 | 0.16 |
| Dye-1 | 0.06 |
| Gelatin | 0.61 |
| Sixth Layer: Intermediate Layer | |
| Gelatin | 0.61 |
| Seventh Layer: Slow Green Sensitive Layer | |
| Silver Iodobromide Emulsion | 0.32 (as silver) |
| Sensitizing Dye-1 | $1.50 \times 10^{-3}$ |
| Sensitizing Dye-2 | $0.5 \times 10^{-3}$ |
| Coupler M-2 | 0.35 |
| Coupler M-1 | 0.15 |
| Solvent-1 | 0.25 |
| Gelatin | 0.86 |
| Eighth Layer: Fast Green Sensitive Layer | |
| Silver Iodobromide Emulsion | 0.43 (as silver) |
| Sensitizing Dye-1 | $0.75 \times 10^{-3}$ |
| Sensitizing Dye-2 | $0.25 \times 10^{-3}$ |
| Coupler M-2 | 0.60 |
| Coupler M-1 | 0.26 |
| Solvent-1 | 0.43 |
| Gelatin | 1.51 |
| Ninth Layer: Yellow Filter Layer | |
| Dye-2 | 0.27 |
| Gelatin | 0.61 |
| Tenth Layer: Intermediate Layer | |
| Competitor-1 | 0.11 |
| Gelatin | 0.61 |
| Eleventh Layer: Slow Blue Sensitive Layer | |
| Silver Iodobromide Emulsion | 0.22 |
| Blue Sensitizing Dye | $1.08 \times 10^{-3}$ |
| Coupler Y-1 | 0.70 |
| Solvent-2 | 0.23 |
| Gelatin | 1.08 |
| Twelfth Layer: Fast Blue Sensitive Layer | |
| Silver Iodobromide Emulsion | 0.54 |
| Blue Sensitizing Dye | $1.60 \times 10^{-3}$ |
| Coupler Y-1 | 1.56 |
| Solvent-2 | 0.52 |
| Gelatin | 2.37 |
| Thirteenth Layer: First Protective Layer | |
| Competitor-1 | 0.06 |
| Gelatin | 1.40 |
| Ultraviolet Absorbing Dyes | 0.51 |
| Fourteenth Layer: Second Protective Layer | |

-continued

| | |
|---|---|
| Fine Grain Silver Bromide (0.07μ equivalent spherical diameter) | 0.12 (as silver) |
| Matte (3.3μ spherical diameter) | 0.02 |
| Bis(vinyl sulfonyl methane) | 0.26 |
| Gelatin | 0.97 |

Samples 102 to 104 were prepared in the same manner as described above for Sample 101 except that the 4-equivalent magenta dye-forming couplers M-1 and M-2 in the Seventh and Eighth Layers in Sample 101 were replaced with the 2-equivalent magenta dye-forming couplers A, B, and C in those layers in Samples 102, 103, and 104, respectively. No Solvent-1 was used in either the Seventh or Eighth layers of Sample 104.

Each of the samples thus prepared was cut into a 35 mm width strip. The samples were stepwise exposed and were processed using standard Kodak E-6® processing solutions and methods. The Status A blue Dmin densities were measured using a densitometer. The samples were then allowed to rest for 24 hrs. on a lighted table top illuminator. After exposure, the Status A blue Dmin was again measured. The measured densities for the processed samples both before and after light exposure are listed in Table I.

TABLE I

| Sample No. | Magenta Coupler | g/m² 7th layer | g/m² 8th layer | Initial Status A B Dmin | Status A B Dmin after 24 hrs on light table | Δ Status A B Dmin |
|---|---|---|---|---|---|---|
| 101 (Comparison) | M-2<br>M-1 | 0.35<br>0.15 | 0.60<br>0.26 | 0.14 | 0.23 | +0.09 |
| 102 (invention) | A | 0.51 | 0.86 | 0.12 | 0.11 | −0.01 |
| 103 (invention) | B | 0.32 | 0.56 | 0.12 | 0.11 | −0.01 |
| 104 (invention) | C | 0.68 | 1.15 | 0.14 | 0.14 | 0.00 |

From the results shown in Table I, a significant amount of undesirable blue density in the Dmin region of the coating is generated for the sample containing the 4-equivalent magenta couplers (Sample 101) in the film with yellow filter dye-2. This yellow stain is avoided when the sample contains a 2-equivalent magenta coupler (Samples 102–104) used with yellow filter Dye-2.

EXAMPLE 2

On a cellulose triacetate film support provided with a subbing layer was coated each layer having the composition set forth below to prepare a multilayer color photographic light-sensitive material, which is designated Sample 201.

In the composition of the layers, the coating amounts are shown as g/m² except for sensitizing dyes, which are shown as the molar amount per mole of silver halide present in the same layer.

| | |
|---|---|
| First Layer: Antihalation Layer | |
| Black Coloidal Silver | 0.43 |
| Gelatin | 2.44 |
| Second Layer: Intermediate Layer | |
| Fine Grain Silver Bromide (0.07μ equivalent spherical diameter) | 0.05 (as silver) |
| Competitor-1 | 0.05 |
| Gelatin | 1.22 |

-continued

| | |
|---|---|
| Third Layer: Slow Red Sensitive Layer | |
| Silver Iodobromide Emulsion | 0.84 |
| Red Sensitizing Dyes | $0.45 \times 10^{-3}$ |
| Cyan Coupler C-1 | 0.27 |
| Solvent-2 | 0.14 |
| Gelatin | 2.44 |
| Fourth Layer: Fast Red Sensitive Layer | |
| Silver Iodobromide Emulsion | 0.97 (as silver) |
| Red Sensitizing Dyes | $0.33 \times 10^{-3}$ |
| Cyan Coupler C-1 | 0.98 |
| Solvent-2 | 0.49 |
| Gelatin | 2.26 |
| Fifth Layer: Intermediate Layer | |
| Competitor-1 | 0.11 |
| Dye-1 | 0.05 |
| Gelatin | 0.75 |
| Sixth Layer: Intermediate Layer | |
| Silver Iodobromide Emulsion | 0.54 (as silver) |
| Sensitizing Dye-1 | $0.46 \times 10^{-3}$ |
| Sensitizing Dye-2 | $0.21 \times 10^{-3}$ |
| Coupler M-2 | 0.13 |
| Coupler M-1 | 0.05 |
| Solvent-1 | 0.09 |
| Gelatin | 0.97 |
| Seventh Layer: Fast Green Sensitive Layer | |
| Silver Iodobromide Emulsion | 0.75 (as silver) |
| Sensitizing Dye-1 | $1.02 \times 10^{-3}$ |
| Sensitizing Dye-2 | $0.38 \times 10^{-3}$ |
| Coupler M-2 | 0.67 |
| Coupler M-1 | 0.29 |
| Solvent-1 | 0.48 |
| Gelatin | 1.72 |
| Eighth Layer: Yellow Filter Layer | |
| Dye-2 | 0.22 |
| Gelatin | 0.72 |
| Ninth Layer: Intermediate Layer | |
| Competitor-1 | 0.11 |
| Gelatin | 0.61 |
| Tenth Layer: Slow Blue Sensitive Layer | |
| Silver Iodobromide Emulsion | 1.34 |
| Blue Sensitizing Dye | $0.39 \times 10^{-3}$ |
| Coupler Y-1 | 1.42 |
| Solvent-2 | 0.71 |
| Gelatin | 2.23 |
| Bis(vinyl sulfonyl methane) | 0.27 |
| Eleventh Layer: Fast Blue Sensitive Layer | |
| Silver Iodobromide Emulsion | 0.37 |
| Blue Sensitizing Dye | $0.39 \times 10^{-3}$ |
| Coupler Y-1 | 0.38 |
| Solvent-2 | 0.19 |
| Gelatin | 0.61 |
| Twelfth Layer: First Protective Layer | |
| UV Absorbing Dyes | 0.51 |
| Gelatin | 1.40 |
| Thirteenth Layer: Second Protective Layer | |
| Fine Grain Silver Bromide (0.07μ equivalent spherical diameter) | 0.12 (as silver) |
| Matte (3.3μ spherical diameter) | 0.02 |
| Gelatin | 0.98 |

Samples 202 and 203 were prepared in the same manner as sample 201, but sample 202 contained no yellow Filter Dye-2 in the Eighth Layer, while sample 203 contained 0.09 g/m² Carey Lea Silver (CLS) in place of Dye-2 in the Eighth Layer.

Each of the samples thus prepared was cut into a 35 mm strip. The samples were stepwise exposed and were processed using standard Kodak E-6® processing solutions and methods. The status A blue Dmin densities were measured using a densitometer. The samples were then placed on a lighted table top illuminator for 28 days, followed by reading of Status A blue Dmin densities by densitometry. The measured densities before and after treatment are listed in Table II.

TABLE II

| Sample No. | Yellow Filter Material | g/m² in Layer | Initial Status A B Dmin | Status A B Dmin after 24 hours on Light Table | Δ Status A B Dmin |
|---|---|---|---|---|---|
| 201 | Dye-2 | 0.22 | 0.16 | 0.24 | 0.08 |
| 202 | None | 0.00 | 0.13 | 0.13 | 0.00 |
| 203 | CLS | 0.09 | 0.14 | 0.14 | 0.00 |

From the results in Table II, the undesirable yellow printout stain is generated an the sample containing both the 4-equivalent magenta couplers M-1 and M-2 and yellow filter Dye-2. The presence of yellow filter dye is necessary, in combination with the 4-equivalent magenta coupler to produce the problem. The benefits of yellow filter dye can only be realized without stain generation when used in combination with a 2-equivalent magenta coupler.

The components employed for the preparation of the light-sensitive materials not already identified above are shown below.

Solvent-1: tritolyl phosphates
Solvent-2: dibutyl phthalate

Competitor-1:

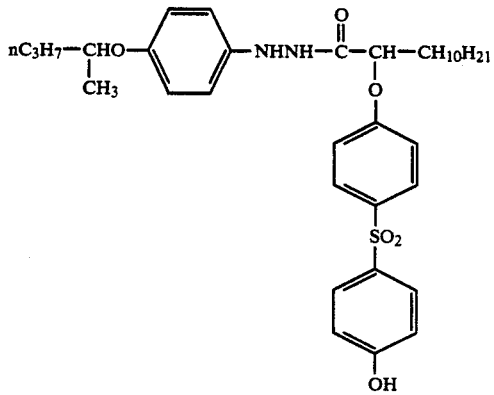

Dye-1:

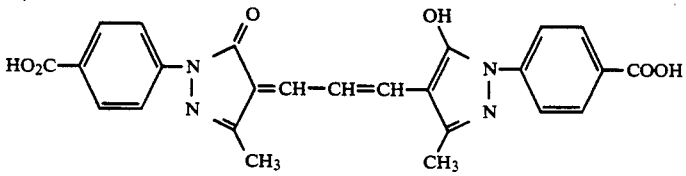

Dye-2:

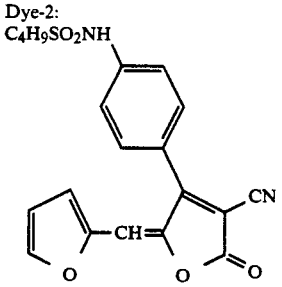

Sensitizing Dye-1:

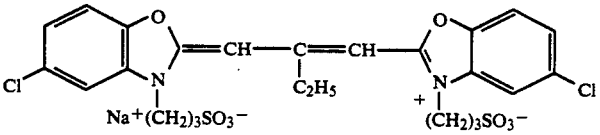

Sensitizing Dye-2:

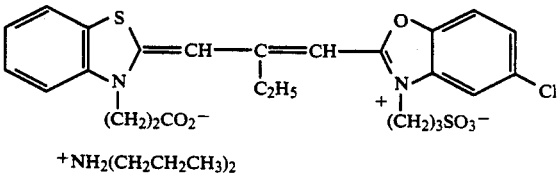

4-Equivalent Magenta Dye-Forming Coupler M-2:

-continued
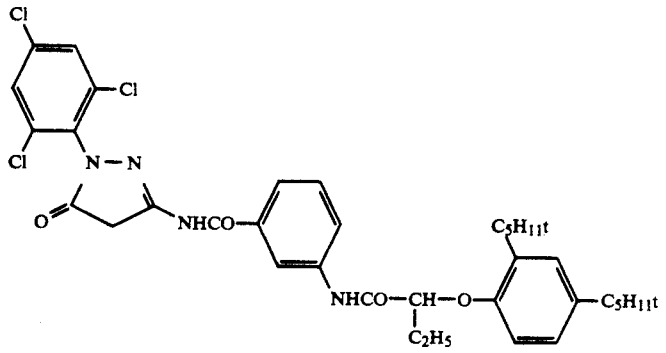
4-Equivalent Magenta Dye-Forming Coupler M-1:
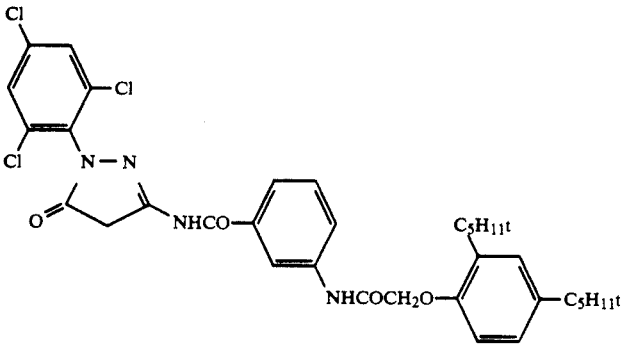
Cyan Coupler C-1:
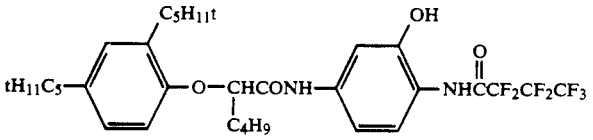
Yellow Coupler Y-1:
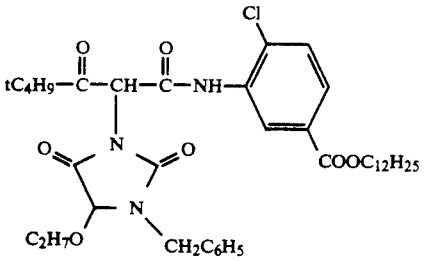
2-Equivalent Magenta Dye-Forming Coupler A:
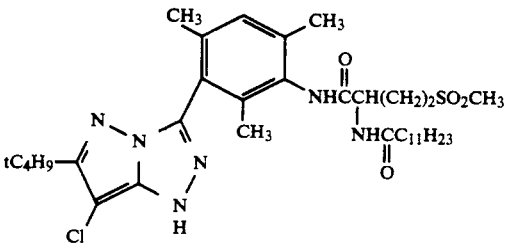
2-Equivalent Magenta Dye-Forming Coupler B:

-continued

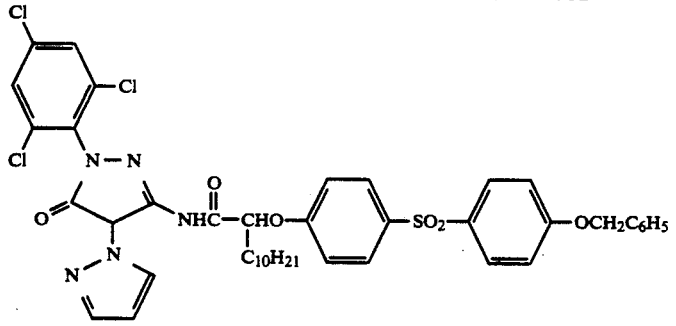

2-Equivalent Magenta Dye-Forming Coupler C:

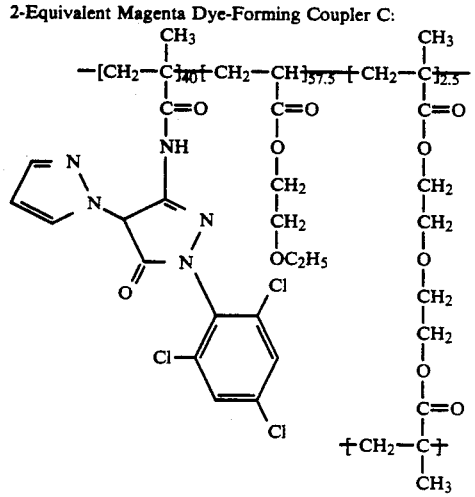

Although the invention has been described in considerable detail with particular reference to certain preferred embodiments thereof, variations and modifications can be effected within the spirit and scope of the invention.

What is claimed is:

1. A photographic element, comprising:

a photographic support;

a green sensitive silver halide emulsion layer on said photographic support and having a magenta dye-forming coupler; and a filter layer on said photographic support and associated with said green sensitive layer, wherein said magenta dye-forming coupler is a 2-equivalent magenta dye-forming coupler, and said filter layer comprises a filter dye molecule having the formula:

$$D{=}CH{-}M \qquad (I)$$

wherein D is a group which, with the remainder of the molecule, forms a dye having an absorption maximum in the blue or green region of the visible spectrum, M is a five-membered or six-membered unsaturated heterocyclic ring, which may be fused with another five-membered or six-membered ring system, and which is unsubstituted or substituted with a lower alkyl group having from 1 to 10 carbon atoms, or an electron withdrawing group.

2. A photographic element according to claim 1, wherein said 2-equivalent magenta dye-forming coupler has the formula:

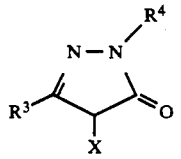

(II)

wherein $R^3$ is a carbonamido group, an arylamino group, a ureido group, a sulfonamido group, an alkylamino group, or a heterocyclic amino group, $R^4$ is a substituted or unsubstituted alkyl or aryl group, and X is a group capable of being released by a coupling reaction with an oxidized aromatic primary amine developing agent.

3. A photographic element according to claim 1, wherein said magenta dye-forming coupler has the formula:

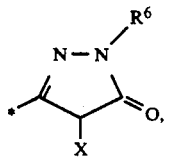

(III)

-continued (IV)

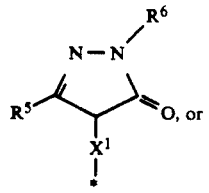

(V)

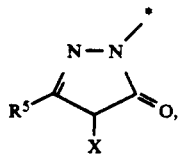

wherein $R^5$ is a substituted or unsubstituted arylamino group, carbonamido group, ureido group, sulfonamido group, alkylamino group, or heterocyclic amino group, $R^6$ is a substituted or unsubstituted alkyl group or aryl group, X is a group capable of being released by a coupling reaction with an oxidized aromatic primary amino developing agent, $X^1$ represents a divalent group derived from X having bonding sites to the pyrazolone ring and to $-(Y)_q-$ in formulas (VI) and (VII) below,

* represents a site for linkage to $-(Y)_q-$ in the formulas (VI) and (VII):

(VI)

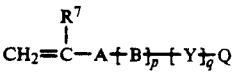

(VII)

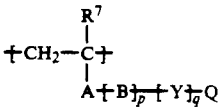

wherein $R^7$ is a hydrogen atom, a lower alkyl group having from 1 to 4 carbon atoms, or a chlorine atom, A is —CONH—, —COO—, —O—, or a phenylene group, B is a substituted or unsubstituted straight or branched chain alkylene group, aralkylene group, or a phenylene group, Y is —CONR'—, —NR'CONR'—, —NR'COO—, —NR'CO—, OCONR'—, —NR'—, —COO—, —OCO—, —CO—, —O—, $-SO_2-$, $-NR'SO_2-$ or $-SO_2NR'-$, wherein R' is a hydrogen atom or a substituted or unsubstituted aliphatic group or aryl group, and when two or more R's are present in one molecule, the R's may be the same or different, q is 0 or 1, p is 0 when q is 0, or 1 when q is 1, and Q represents the structure of formulas (III), (IV), and (V).

4. A photographic element according to claim 3, wherein $R^5$ is an anilino group.

5. A photographic element according to claim 2, wherein $R^3$ is an anilino group.

6. A photographic element according to claim 1, wherein said 2-equivalent magenta dye-forming coupler has the formula:

(VIII)

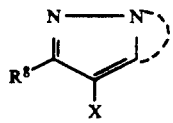

wherein $R^8$ is a hydrogen atom or a substituted or unsubstituted alkyl, aryl, alkoxy or aryloxy group.

X is a group capable of being released by a coupling reaction with an oxidized aromatic primary amine developing agent, and J represents the non-metallic atoms necessary to complete a heterocyclic ring.

7. A photographic element according to claim 6, wherein said 2-equivalent magenta dye-forming coupler has the formula:

(IX)

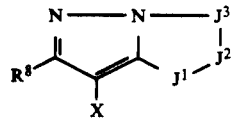

wherein $J^1$, $J^2$, and $J^3$ each represents a substituted or unsubstituted methine group, =N—, or —NH—, where one of either the $J^1$—$J^2$ bond or the $J^2$—$J^3$ bond is a double bond with the other being a single bond, when the $J^2$—$J^3$ bond is a carbon—carbon double bond, it may form part of an aromatic ring, and when any one of $R^8$, X, and a substituted methine group represented by $J^1$, $J^2$, or $J^3$ is a divalent or polyvalent group, said 2-equivalent magenta dye-forming coupler may form a dimer or a polymer.

8. A photographic element according to claim 1, wherein M is selected from the group consisting of furan, thiophene, pyridine, pyrrole, and imidazole.

9. A photographic element according to claim 1, wherein said filter dye has the formula:

(X)

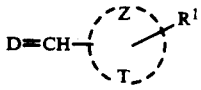

wherein T is —O—, —S—, or $-NR^2-$, wherein $R^2$ is a bridging bonding valence, a hydrogen atom, or a lower alkyl group having from 1 to 4 carbon atoms, $R^1$ is a hydrogen atom, a lower alkyl group having from 1 to 10 carbon atoms, or an electron withdrawing group, and Z represents the atoms necessary to complete a five-membered or six-membered unsaturated heterocyclic ring containing T and additionally up to 1 nitrogen atom, the remainder of the ring atoms being carbon atoms.

10. A photographic element according to claim 9, wherein said filter dye has the formula:

(XI)

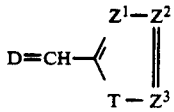

wherein $Z^1$, $Z^2$, and $Z^3$ each independently represents —$CR^{10}$— or —N—, wherein at least two of $Z^1$, $Z^2$, and $Z^3$ are —$CR^{10}$— and each $R^{10}$ is independently a hydrogen atom, a lower alkyl group having 1 to 10 carbon atoms, or an electron withdrawing group.

11. A photographic element according to claim 9, wherein said filter dye has the formula:

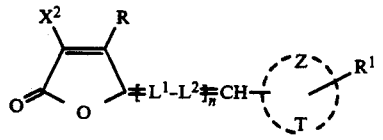

(XII)

wherein R is a substituted or unsubstituted alkyl group or aryl group, $X^2$ is an electron withdrawing group, $L^1$ and $L^2$ are each independently a substituted or unsubstituted methine group, and n is 0 or a positive integer from 1 to 6.

12. A photographic element according to claim 11, wherein $X^2$ is selected from the group consisting of cyano, substituted or unsubstituted carboxylate, substituted or unsubstituted aryl, and —$COR^9$—, wherein $R^9$ is a primary or secondary amino group.

13. A photographic element according to claim 11, wherein n is 0.

14. A photographic element according to claim 11, wherein $X^2$ is cyano.

15. A photographic element according to claim 9, wherein said filter dye has the formula

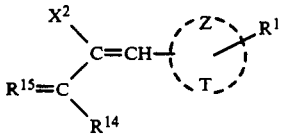

(XIII)

wherein $X^2$ is an electron withdrawing group, $R^{14}$ is a substituted or unsubstituted aryl or heterocyclic group, and $R^{15}$ is an oxygen atom, or

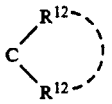

(XIV)

wherein $R^{12}$ and $R^{13}$, which may be the same or different, are each independently substituted or unsubstituted alkyl or aryl groups, carbonyl groups, cyano grups, nitrogen- or oxygen-containing heterocyclic groups, primary or secondary amino groups, or oxygen atoms, and wherein $R^{12}$ and $R^{13}$ may bond to form a ring, as indicated by the dashed line connecting $R^{12}$ and $R^{13}$ in formula (XIV).

16. A photographic element according to claims 1, 2, 3, 9, 10, 11, or 15, wherein the element is a color reversal photographic element.

17. A photographic element according to claims 1, 2, 3, 9, 10, 11 or 15, wherein the element is a color negative photographic element.

18. A photographic element according to claim 11, wherein the filter dye is selected from the group consisting of:

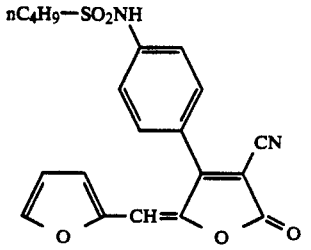

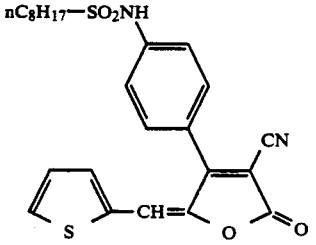

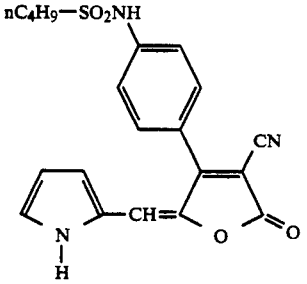

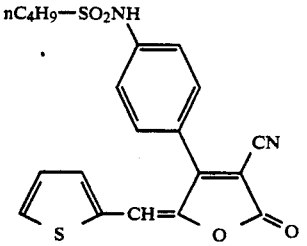

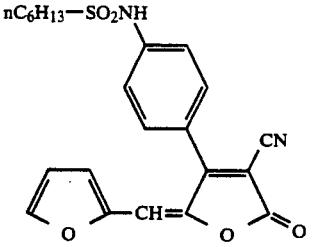

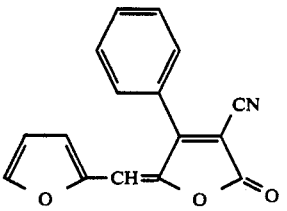

-continued
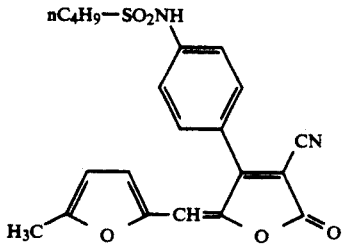
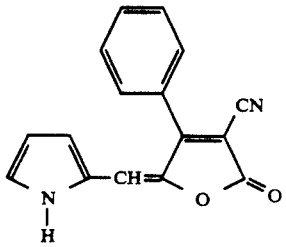
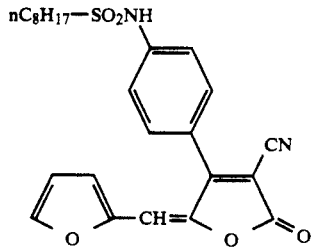
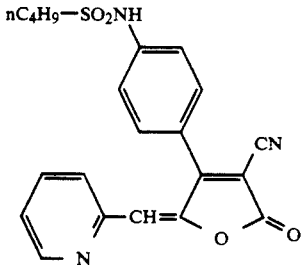
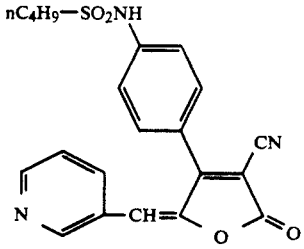
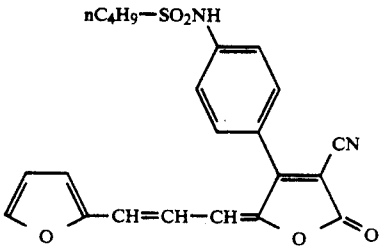
-continued
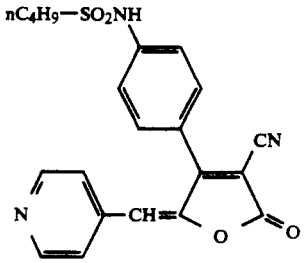
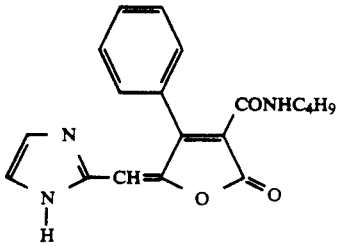
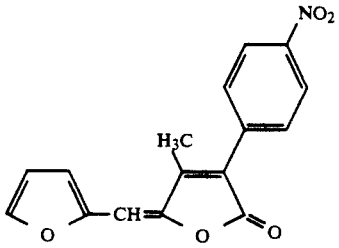
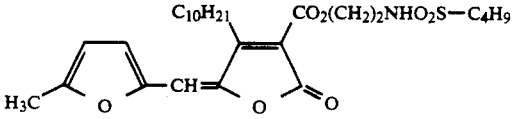
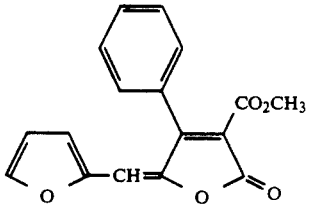
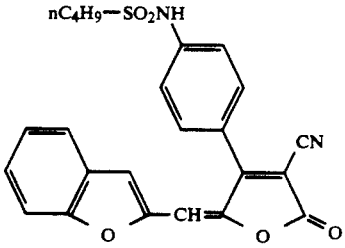
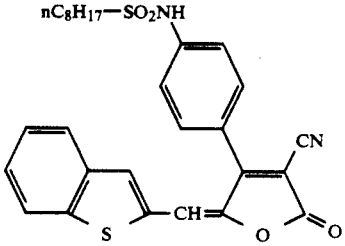

-continued
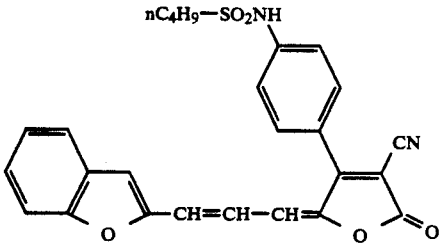
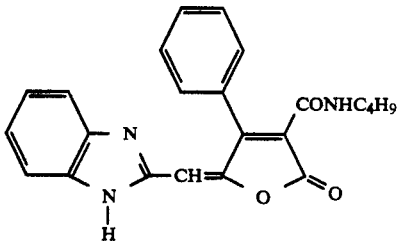
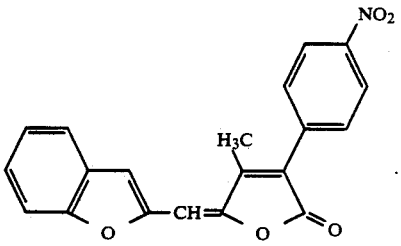
19. A photographic element according to claim 15, wherein the filter dye is selected from the group consisting of
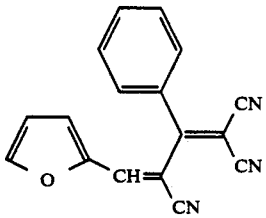
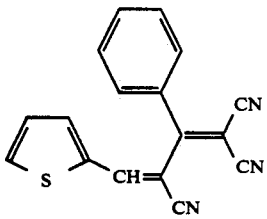
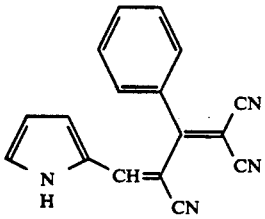
-continued
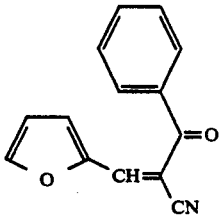
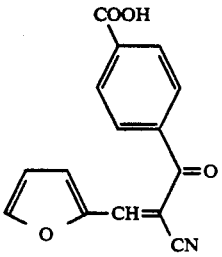
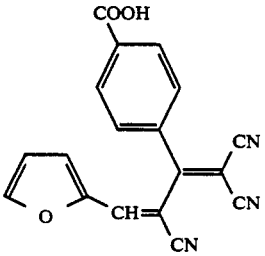
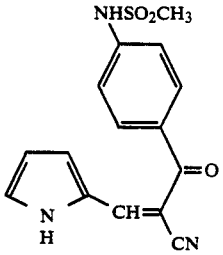
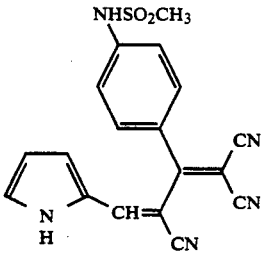
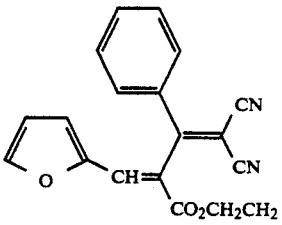

-continued
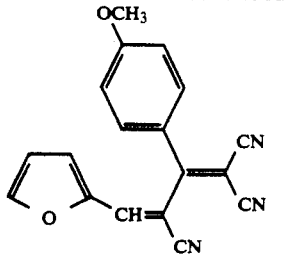
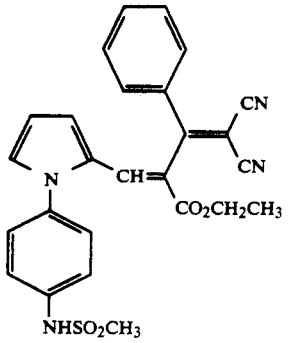
-continued
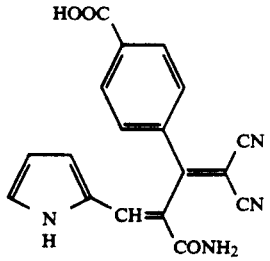
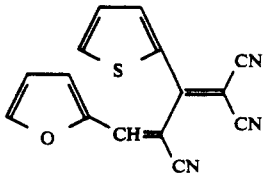
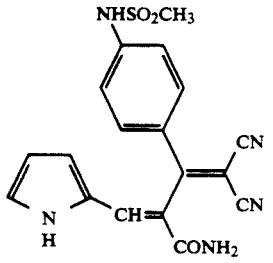
20. A photographic element according to claim 1, wherein the magenta dye-forming coupler is selected from the group consisting of:
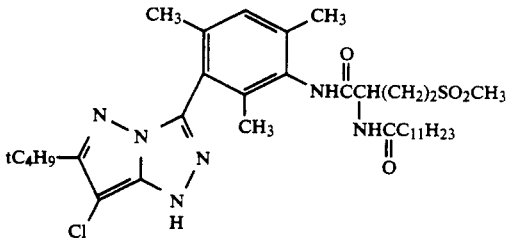
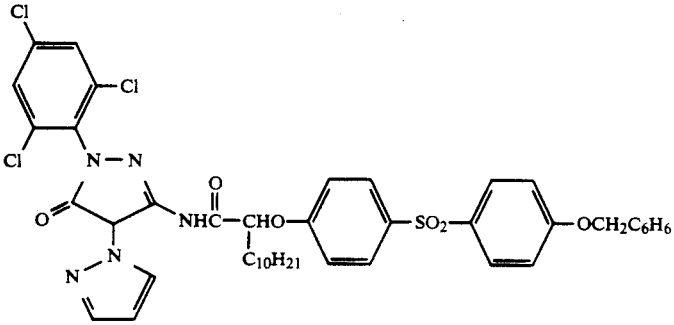

-continued
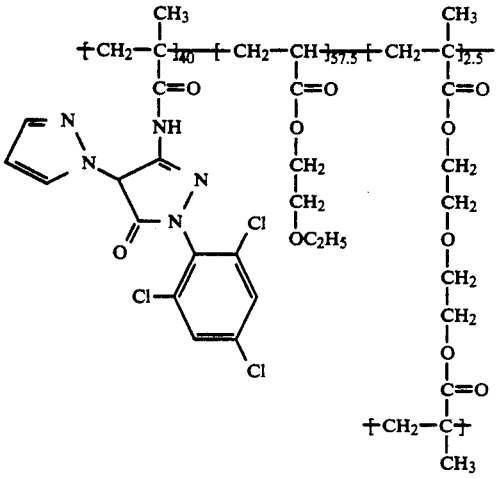
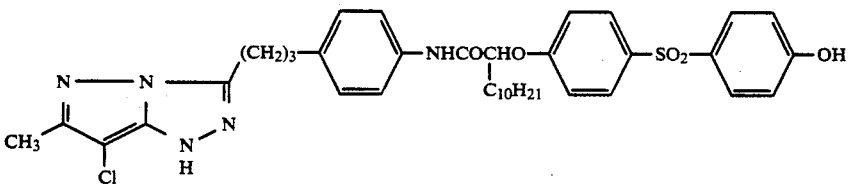
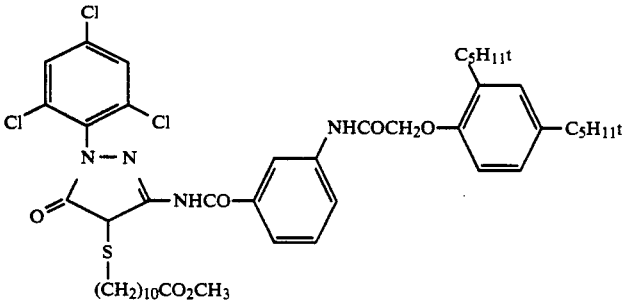
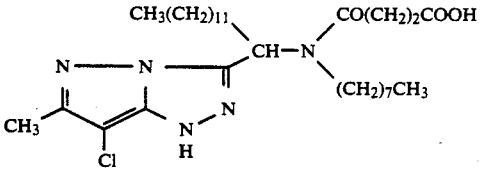
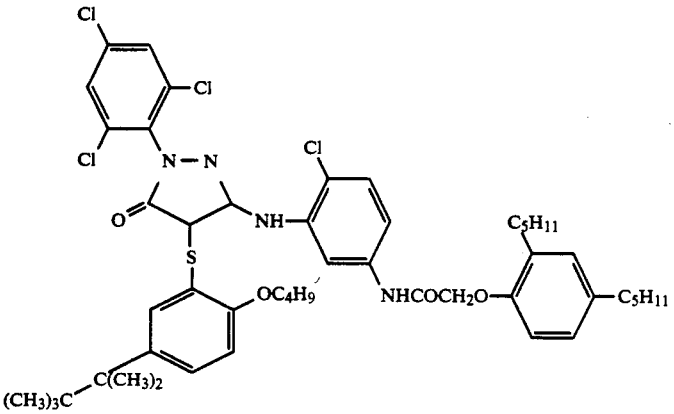

-continued

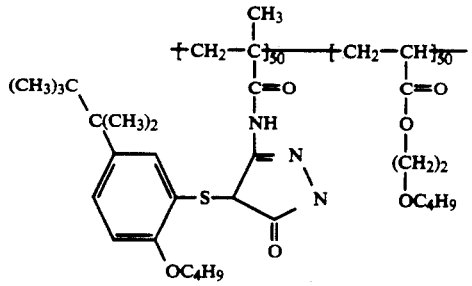

21. A photographic element according to claim 1, wherein said filter layer is closer to said support than said green sensitive layer.

22. A photographic element according to claim 1, wherein said green sensitive layer is closer to said support than said filter layer.

23. A photographic element free of colored couplers, comprising:

a photographic support;

a green sensitive silver halide emulsion layer on said photographic support and having a magenta dye-forming coupler; and a filter layer on said photographic support and associated with said green sensitive layer, wherein said magenta dye-forming coupler is a 2-equivalent magneta dye-forming coupler, and said filter layer comprises a filter dye molecule having the formula:

$$D{=}CH{-}M \qquad (I)$$

wherein D is a group which, with the remainder of the molecule, forms a dye having an absorption maximum in the blue or green region of the visible spectrum, and M is a five-membered or six-membered unsaturated heterocyclic ring, which may be fused with another five-membered or six-membered ring system, and which is unsubstituted or substituted with a lower alkyl group having from 1 to 10 carbon atoms, or an electron withdrawing group.

24. A photographic element according to claim 23, wherein said magenta dye-forming coupler has the formula:

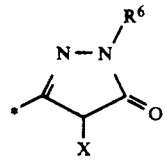

(III)

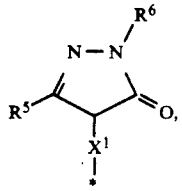

(IV)

or

-continued

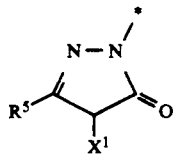

(V)

wherein $R^5$ is a substituted or unsubstituted arylamino group, carbonamido group, uneido group, sulfonamido group, alkylamino group, or heterocyclic amino group, $R^6$ is a substituted or unsubstituted alkyl group or aryl group, X is a group capable of being released by a coupling reaction with an oxidized aromatic primary amino developing agent, $X^1$ represents a divalent group derived from X having bonding sites to the pyrazolone ring and to $-(Y)_q-$ in formulas (VI) and (VII) below,

*represents a site for linkage to $-(Y)_q-$ in the formulas (VI) and (VII):

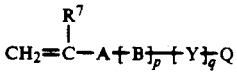

(VI)

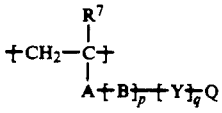

(VII)

wherein $R^7$ is a hydrogen atom, a lower alkyl group having from 1 to 4 carbon atoms, or a chlorine atom, A is —CONH—, —COO—, —O—, or a phenylene group, B is a substituted or unsubstituted straight or branched chain alkylene group, aralkylene group, or a phenylene group, Y is —CONR'—, —NR'CONR'—, —NR'COO—, —NR'CO—, OCONR'—, —NR'—, —COO—, —OCO—, —CO—, —O—, $-SO_2-$, $-NR'SO_2-$ or $-SO_2NR'-$, wherein R' is a hydrogen atom or a substituted or unsubstituted aliphatic group or aryl group, and when two or more R's are present in one molecule, R's may be the same or different, q is 0 or 1, p is 0 when q is 0, or 1 when q is 1, and Q represents the structure of formulas (III), (IV), and (V), and wherein said filter dye has the formula:

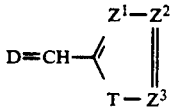

(XI)

* * * * *

UNITED STATES PATENT AND TRADEMARK OFFICE

CERTIFICATE OF CORRECTION

PATENT NO. : 5,298,377

DATED : March 29, 1994

INVENTOR(S) : Arlyce T. Bowne

It is certified that error appears in the above-indentified patent and that said Letters Patent is hereby corrected as shown below:

Col 36, line 5, delete " 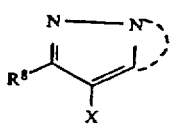 " and insert --- 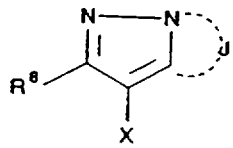 ---.

Col 37, line 50, delete " 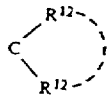 " and insert --- 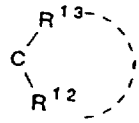 ---.

Col 42, line 65, delete " 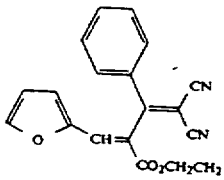 " and insert --- 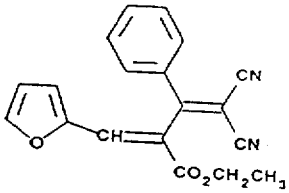 ---.

IN THE UNITED STATES PATENT AND TRADEMARK OFFICE

CERTIFICATE OF CORRECTION

PATENT NO. : 5,298,377

DATED : March 29, 1994

INVENTOR(S) : Arlyce T. Bowne

Cols 43-44, line 35, delete

" 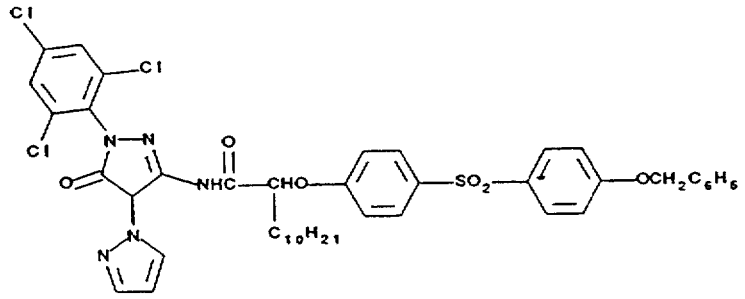 "

and insert

--- 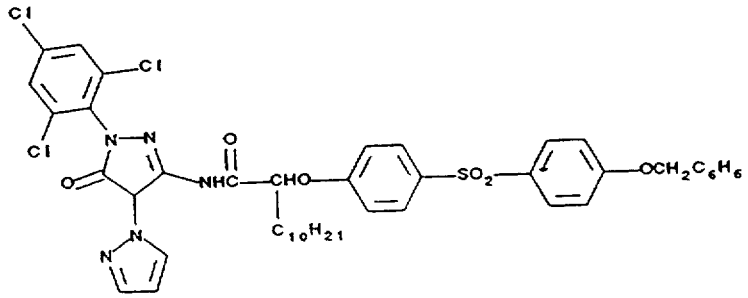 ---.

IN THE UNITED STATES PATENT AND TRADEMARK OFFICE

CERTIFICATE OF CORRECTION

PATENT NO. : 5,298,377

DATED : March 29, 1994

INVENTOR(S) : Arlyce T. Bowne

Col 47, line 10, delete

"

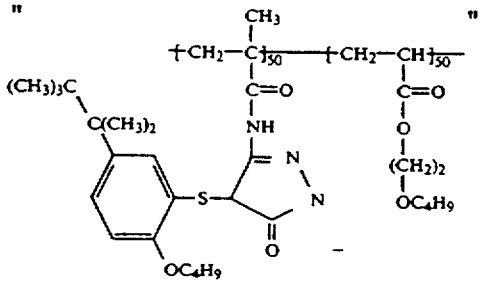

"

and insert

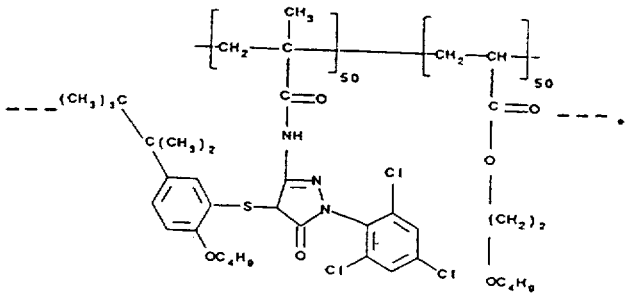

Signed and Sealed this

Eighteenth Day of October, 1994

*Attest:*

*Attesting Officer*

BRUCE LEHMAN

*Commissioner of Patents and Trademarks*